US012606980B2

(12) United States Patent
Vera Torres et al.

(10) Patent No.: US 12,606,980 B2
(45) Date of Patent: Apr. 21, 2026

(54) SNUBBER FOR EXCAVATOR BUCKET DOOR

(71) Applicant: Minetec S.A., Santiago (CL)

(72) Inventors: Bernardo Luis Vera Torres, Santiago (CL); Claudio Devon Zamorano Jones, Santiago (CL); Cristian Francisco Zaldívar Espinoza, Santiago (CL)

(73) Assignee: Minetec S.A., Santiago (CL)

( * ) Notice: Subject to any disclaimer, the term of this patent is extended or adjusted under 35 U.S.C. 154(b) by 348 days.

(21) Appl. No.: 18/335,463

(22) Filed: Jun. 15, 2023

(65) Prior Publication Data

US 2023/0407590 A1 Dec. 21, 2023

(30) Foreign Application Priority Data

Jun. 15, 2022 (CL) ..... 202201620

(51) Int. Cl.
*E02F 3/407* (2006.01)
*E02F 9/22* (2006.01)

(52) U.S. Cl.
CPC ..... *E02F 3/4075* (2013.01); *E02F 9/2207* (2013.01)

(58) Field of Classification Search
CPC ..... E02F 3/4075; E02F 9/2203; E02F 9/2207
USPC ..... 37/444, 445
See application file for complete search history.

(56) References Cited

U.S. PATENT DOCUMENTS 4,981,199 A * 1/1991 Tsai ..... F16F 9/20 482/73
5,735,067 A * 4/1998 Isley et al. ..... E02F 3/4075 37/444
5,815,960 A * 10/1998 Soczka ..... E02F 3/4075 37/444
6,219,946 B1 * 4/2001 Soczka ..... E02F 3/308 37/444
2012/0260538 A1 * 10/2012 Schob et al. ..... E02F 3/4075 188/308
2017/0009423 A1 * 1/2017 Zamorano Jones et al. ..... E02F 3/4075
2018/0087593 A1 * 3/2018 Popp et al. ..... E02F 3/401

* cited by examiner

*Primary Examiner* — Tara Mayo
(74) *Attorney, Agent, or Firm* — Hoffman Warnick LLC

(57) ABSTRACT

A snubber for an excavator bucket, comprising: a circular body with a chamber having circular side plates; a shaft mounted on the circular side plates by means of bearings; a vane on said shaft inside the chamber that rotates in solidarity with it, where the vane is in contact with the circular side plates; a sealing surface on the vane; a vane blade, inside the chamber, where the vane blade and the vane divide the chamber into a first sub chamber and a second sub chamber, wherein the vane comprises sealing means adjacent to each of the circular side plates of the chamber, in which the sealing means comprise sealing plates commanded by springs supported at one end to the sealing plates and at the other end to a surface of a housing of the vane, causing the sealing plates to be pressed permanently against the circular side plates.

13 Claims, 11 Drawing Sheets

SNUBBER FOR EXCAVATOR BUCKET DOOR

TECHNICAL FIELD

The invention is developed in the field of elements for earthmoving equipment, specifically referring to a snubber for an excavator bucket door.

DESCRIPTION OF THE PRIOR ART

Regarding the state of the art regarding the proposed invention, application CL 2281-1997 may be mentioned, which discloses a damping system that dampens the swing of the door in the bucket of an excavator that prevents the door from slamming shut. The damping system comprises a cover mountable to an excavator bucket and a shaft rotatably mounted in the cover, being connected to a door of the excavator. The cover has a cylindrical cavity around the axis, being divided into two end parts by means of an obstruction piece and a cam arm. Said cam arm allows hydraulic fluid to flow through an orifice between the end walls, as the shaft rotates, where the cam arm includes end seals against the end walls of the cavity. The end seals are forced out by hydraulic pressure when the door is closed and a one-way valve allows hydraulic fluid to bypass the orifice as the door is opened. The damping system of the invention requires less maintenance than a known friction damping system.

Another document that can be mentioned is CL 932-2012 that discloses a bucket and braking drum for a mining excavator, it includes a bucket and a door rotatably coupled to the body of the bucket, the drum comprises a casing with an internal wall, a shaft rotatably coupled to the cover, a vane placed inside the chamber, a valve or wall positioned, and a first and second valve; while the bucket has a bucket body, a bucket door and a braking drum.

A third document that can be mentioned is U.S. Pat. No. 9,605,405 that discloses A shock absorber for a machine includes a housing, a shaft, and a pinion that is coupled to the shaft. The casing is mounted on a machine implement. The shaft is rotatably housed within the housing and is operatively coupled to a movable component of the implement. The snubber also includes a cylinder defining a cavity, a piston slidably housed within the cylinder, a rack coupled to the piston, and a hydraulic device. The cylinder is arranged at least partly within the casing. The piston divides the cylinder cavity into a first chamber and a second chamber. The rack engages with the pinion to convert a rotation of the shaft into a linear movement of the piston. The hydraulic device is in fluid communication with the cavity and controls a flow of fluid between the first chamber and the second chamber to oppose rotation of the shaft.

None of the above documents discloses sealing means independent of snubber pressures and permanently controlled by groups of springs to avoid deformations and loss of performance of an excavator bucket door snubber that is generated by internal pressures. of the snubber during its operation.

DESCRIPTION OF THE INVENTION

The invention discloses a snubber for an excavator bucket door that permanently controls the deformation due to the effect of work pressures during operation, improving braking performance, being composed of a circular body with a chamber and circular side plates; a shaft mounted to said circular body; a lollipop; a paddle blade; and a valve box in which the snubber has sealing means that make it possible to compensate for the deformations resulting from the high pressures that are generated inside two sub-chambers that divide the chamber of said snubber, improving the sealing between both sub-chambers.

BRIEF DESCRIPTION OF THE FIGURES

The accompanying figures are included to provide a better understanding of the invention and constitute part of this description, in addition they illustrate a preferred embodiment of the invention, where it is seen that.

DETAILED DESCRIPTION OF THE INVENTION

Figure 1:
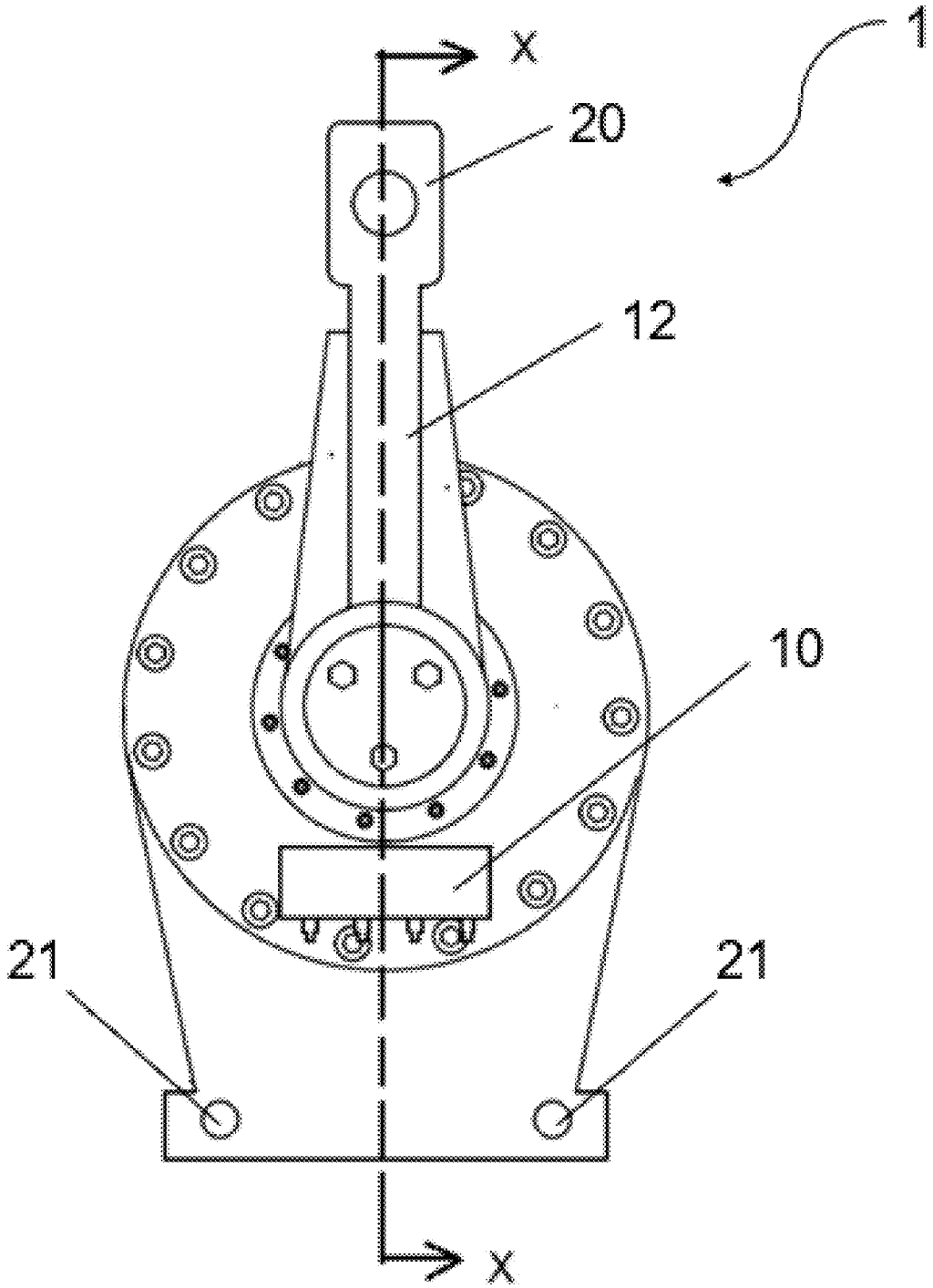
FIG. 1 shows a front view of the snubber in a preferred embodiment.
Figure 2:
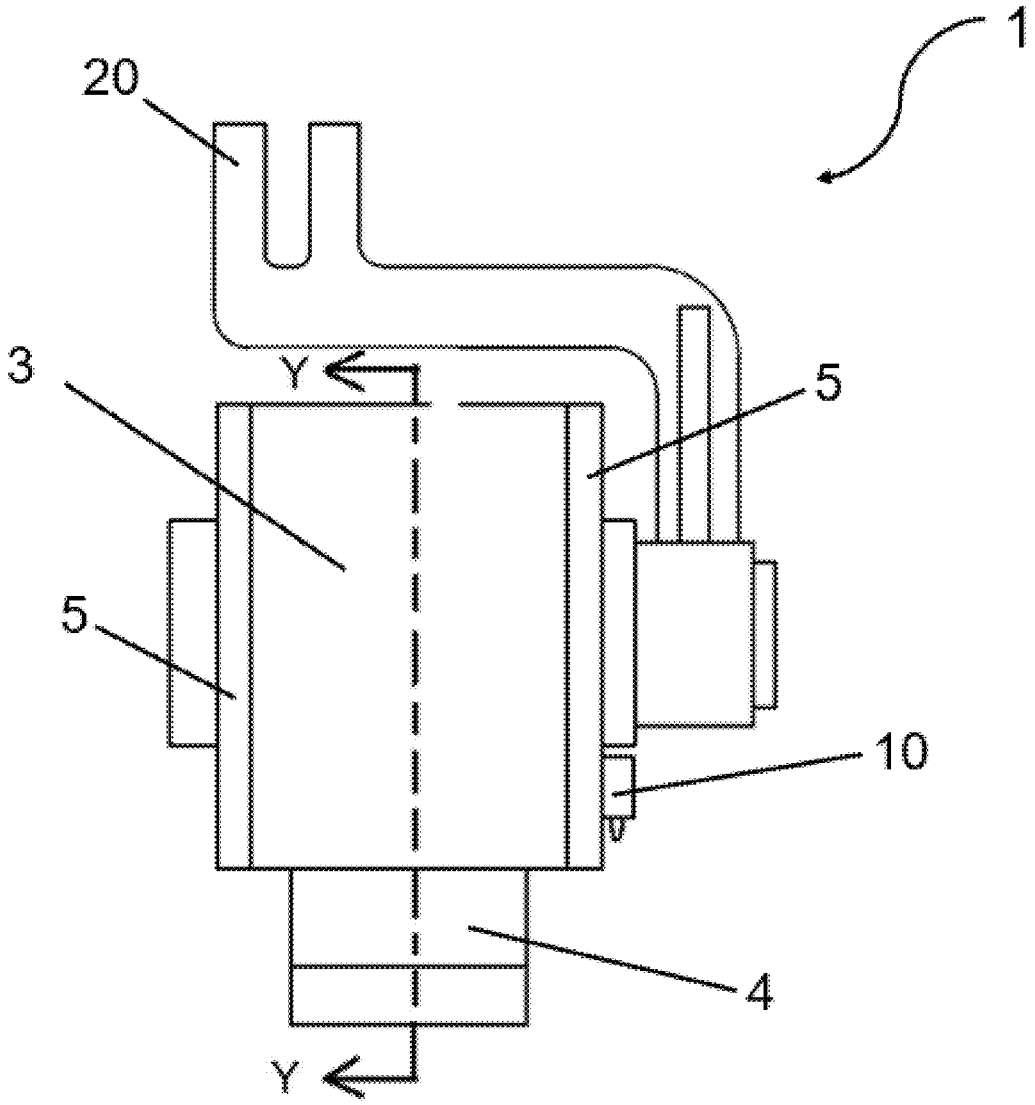
FIG. 2 shows a side view of the snubber in a preferred embodiment.
Figure 3:
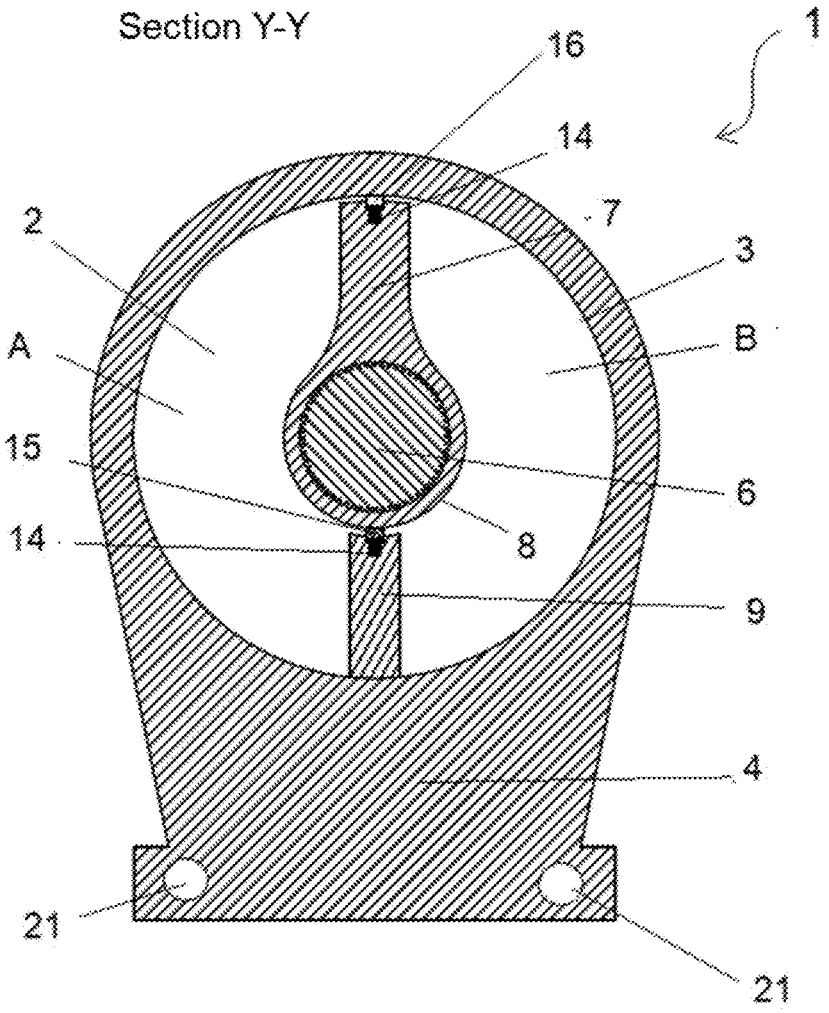
FIG. 3 shows a front sectional view of the snubber in a preferred embodiment.
Figure 4:
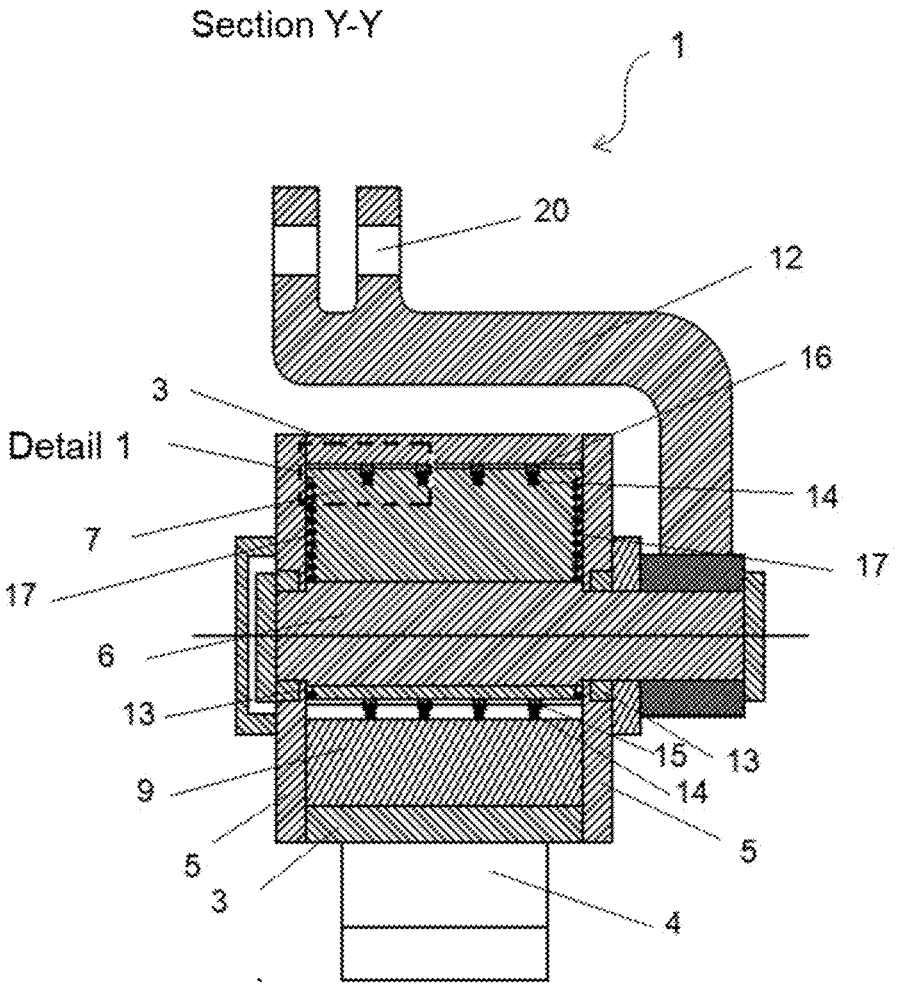
FIG. 4 shows a side sectional view of the snubber in a preferred embodiment.

The invention consists of a snubber (1) for excavator bucket doors that makes it possible to compensate for the deformations caused by the high pressures generated inside said snubber. The snubber is made up of a chamber (2) located inside a circular body (3) with a mounting foot (4) and perforations (21) that allow it to be mounted on an excavator shovel, where said chamber (2) having circular side plates (5). The snubber also consists of a shaft (6) that crosses the chamber (2) and extends through one of the circular side plates (5) connecting on the outside of the chamber (2) to an arm (12). connected to the door of the excavator by means of a hooking lug (20) that allows a pivotal movement to be given to said shaft (6) with respect to the circular body (3). The shaft is rotatably mounted to the circular side plates (5) by means of bearings (13).

The chamber (2) has inside a vane (7) mounted integrally on the shaft (6), the vane (7) being coupled in a sliding manner and as a seal with respect to the circular side plates (5) and said vane (7) has a sealing surface (8). Inside the chamber (2) there is also a vane blade (9) which extends from the inner surface of the circular body (3) to the sealing surface (8) between the circular side plates (5). The vane (7) and the vane blade (9) divide the chamber (2) into a first sub-chamber (A) and a second sub-chamber (B). The shaft (6) is grooved inside the chamber (2) preventing the vane (7) from rotating with respect to itself.

To achieve the sealing of the first sub-chamber (A) and the second sub-chamber (B), the vane blade (9) has a seal (15) on its upper part, where the vane blade (9) presses said seal (15) against the sealing surface (8) of the vane (7), while the vane (7) has a seal (16) on its upper part, where the vane (7) presses said seal (16) against the inner surface of the circular body (3), in both cases the pressure of said seals (15, 16) is commanded by means of springs (14).

On the outside of the snubber (1) there is a valve box (10) that contains valves (22, 23, 24, 25, 26, 27) that can, according to the different connections with the first sub-chamber (A) and the second sub-chamber (B), achieve double effect control over the snubber (1) and, consequently, over the opening and/or closing speed of the excavator bucket door.

The valve box (10) controls the flow of fluid from the first sub-chamber (A) to the second sub-chamber (B) to oppose the rotation of the snubber shaft (6) in a first direction. The valve box (10) also controls the flow of fluid from the second sub-chamber (B) to the first sub-chamber (A) to oppose the rotation of the snubber shaft (6) in a second direction opposite to said first direction.

Figure 5:
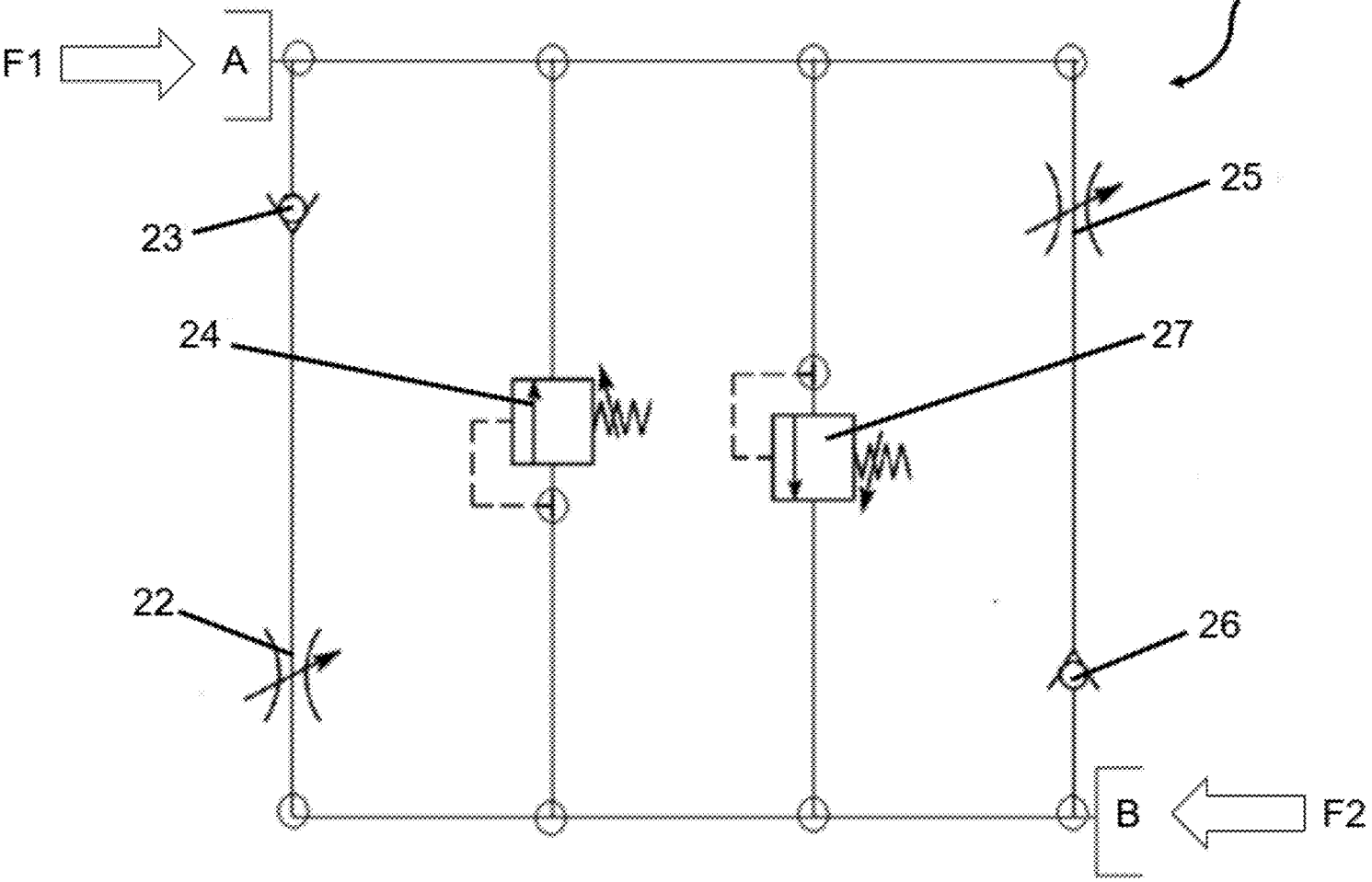
FIG. 5 shows the hydraulic circuit of the valve box in a preferred embodiment.

As indicated in FIG. 5, which shows a preferred hydraulic circuit for the valve box (10), the hydraulic circuit comprises a first module and a second module to control the flow of liquid, said hydraulic circuit being in fluid communication with the sub chambers (A, B). The liquid flow can enter in one direction into the valve box (10) according to the upper left arrow (F1), from the first sub-chamber (A), or in the opposite direction according to the lower arrow. right (F2), from the second sub camera (B).

In this regard, the first module, which controls the flow of liquid from the first sub-chamber (A) to the second sub-chamber (B), comprises a needle valve (22) and a one-way valve (23) arranged in series; and a relief valve (24) arranged in parallel to said valves. The needle valve (22) is in fluid communication with the first subchamber (A) and restricts the passage of fluid that passes through the one-way valve (23), which in turn allows the passage of fluid to the second subchamber. chamber (B), restricting flow in the opposite direction. The relief valve (24) is responsible for controlling the flow of liquid when a pre-established pressure is exceeded inside the first sub-chamber (A), allowing the passage of liquid through the relief valve (24) when exceeds said pressure, in order to decrease the pressure inside the first sub-chamber (A).

Equivalently, the second module, which controls the flow of liquid from the second sub-chamber (B) to the first sub-chamber (A), comprises a needle valve (25) and a one-way valve (26) arranged in series; and a relief valve (27) arranged in parallel to said valves. The needle valve (25) is in fluid communication with the second subchamber (B) and restricts the passage of fluid that passes through the one-way valve (26), which in turn allows the passage of fluid to the first subchamber. chamber (A), restricting flow in the opposite direction. The relief valve (27) is responsible for controlling the flow of liquid when a pre-established pressure is exceeded inside the second sub-chamber (B), allowing the passage of liquid through the relief valve (27) when said pressure is exceeded, in order to decrease the pressure inside the second sub-chamber (B).

In this way, the relief valves (24, 27) control the flow in the event that a pre-established pressure is exceeded within the sub-chambers (A, B) and the needle valves (22, 25) restrict the passage of fluid that passes through the one-way valves (23, 26) in one direction or another, thus controlling the opening or closing speed of the door of the excavator bucket attached to the snubber.

The valve box (10) can also include an oil filter in the hydraulic circuit in the lines of the one-way valves (23, 26) to increase the useful life of the snubber (1), protecting the valves and their internal components.

Figure 6:
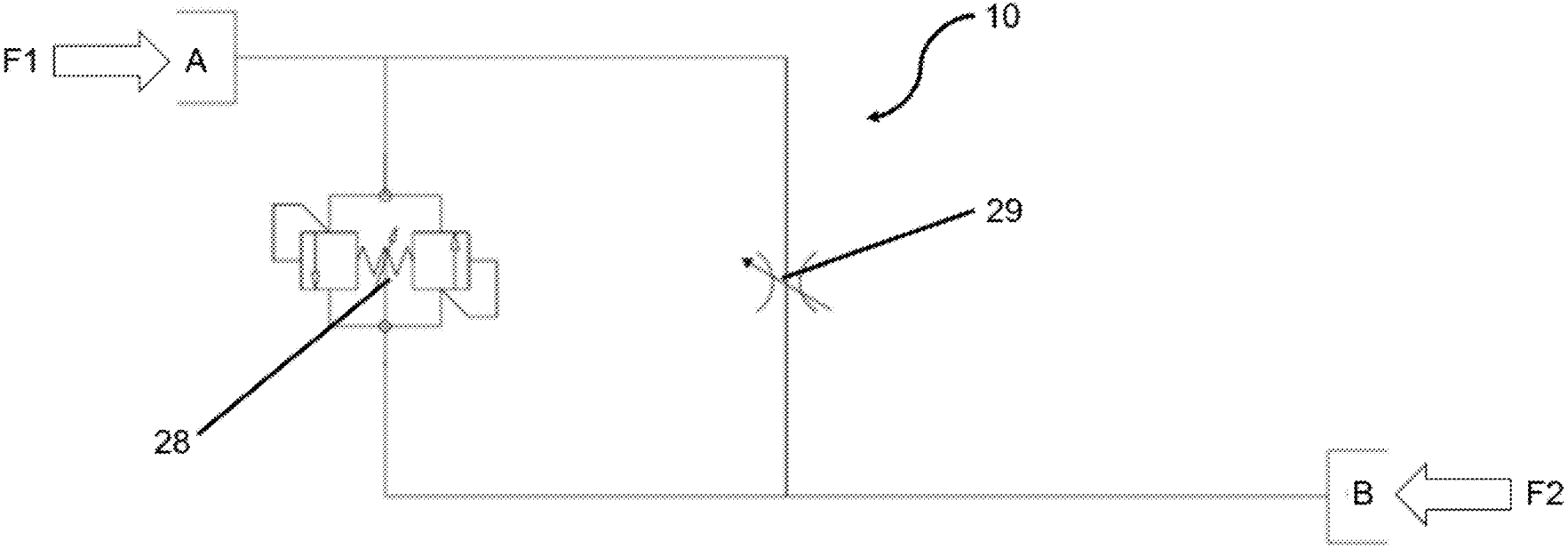
FIG. 6 shows the hydraulic circuit of the valve box in an alternative mode.

Alternatively, the configuration of the valves in the valve box (10) can be simplified according to the hydraulic circuit shown in FIG. 6, so that the hydraulic circuit comprises a bidirectional relief valve (28) and a needle valve (29) arranged in parallel and in fluid communication with the sub chambers (A, B).

Figure 7:
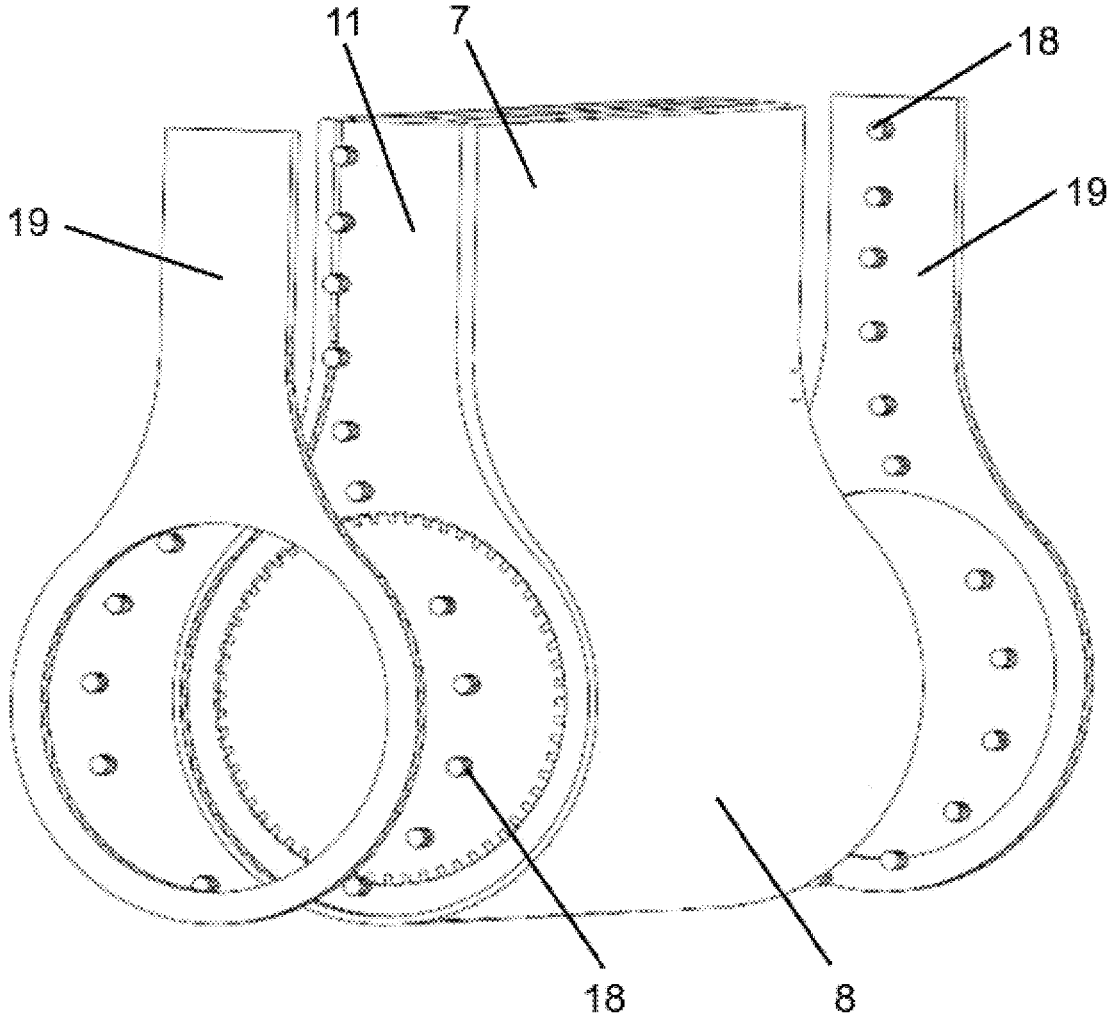
FIG. 7 shows an isometric view of the vane and spring-loaded sealing means in a preferred embodiment.
Figure 8:
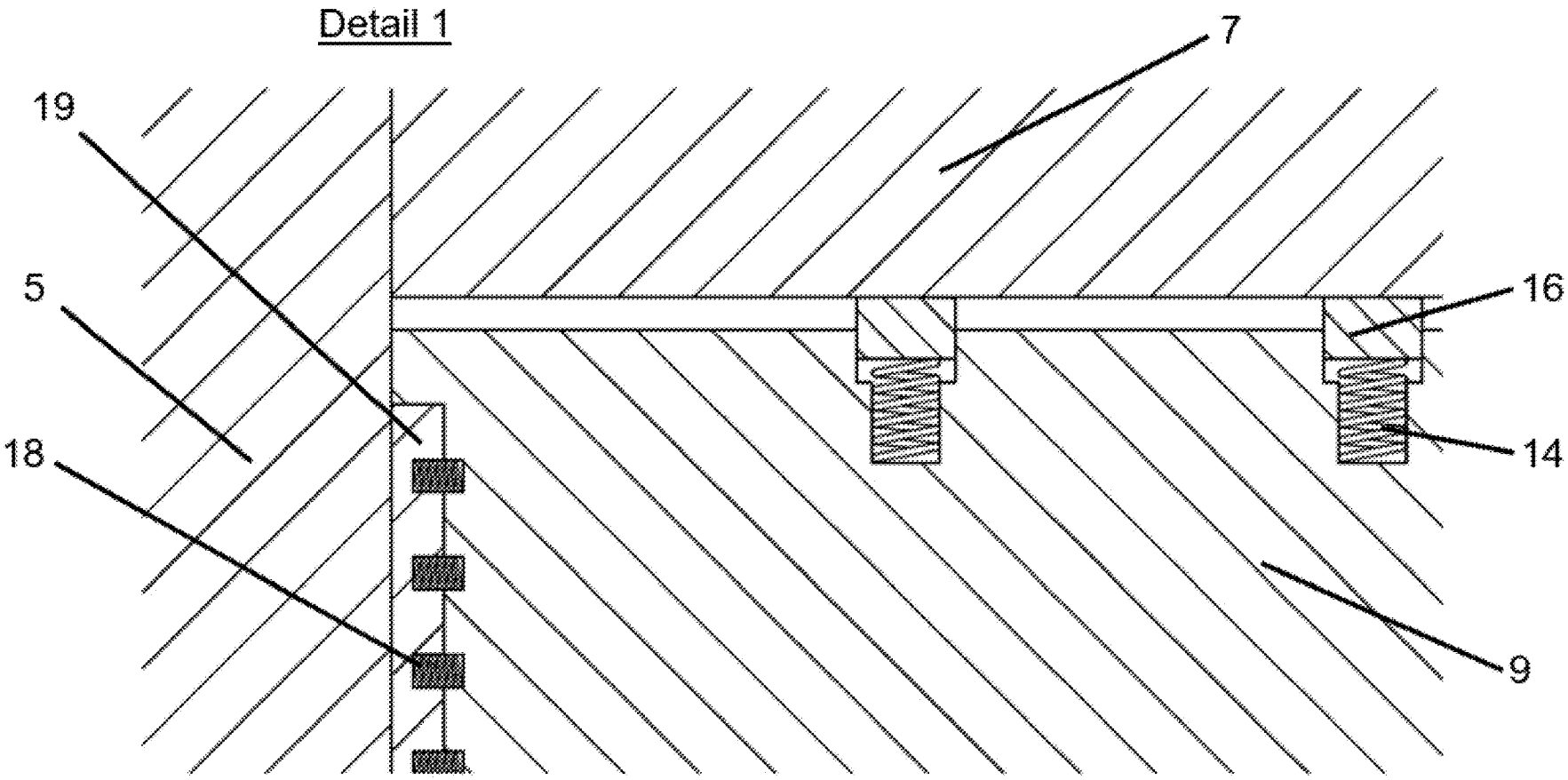
FIG. 8 shows detail 1 of FIG. 4.

Depending on the direction of movement that the excavator bucket door gives to the arm (12) and consequently to the shaft (6) that commands the vane (7), pressure is generated either in the first sub-chamber (A) or in the second sub-chamber (B), the increase in pressure in the chamber (2) produces deformations in the circular side plates (5) and pressure is generated from one sub-chamber to another, decreasing the effectiveness of the braking effect. In order to compensate for possible deformations caused by high pressures in the sub-chambers (A, B) and to generate a seal in the snubber elements due to the inherent play in manufacturing, the vane (7) includes sealing means (17) that comprise sealing plates (19) commanded by springs (18) in which the sealing plates (19) are adjacent to each of the circular side plates (5) of the chamber (2), the springs (18) are supported by one end to the sealing plates (19) and at the other end to a surface of a housing (11) in the vane (7) from which said sealing plates (19) enter or exit according to the deformations and play that are produced in the circular side plates (5) due to the effect of the working pressures inside the snubber (1), in the sub-chambers (A, B). The springs (18) allow the sealing plates (19) to be permanently pressed against the circular side plates (5) avoiding the passage of pressure between the sub-chambers (A, B). In FIG. 7, a preferred arrangement for the springs (18) between the sealing plates and the housing surface (11) is shown, where the number of springs (18) in each sealing plate (19) is between quarter past ten. Preferably, the sealing plates (19) are metallic or plastic.

Figure 9:
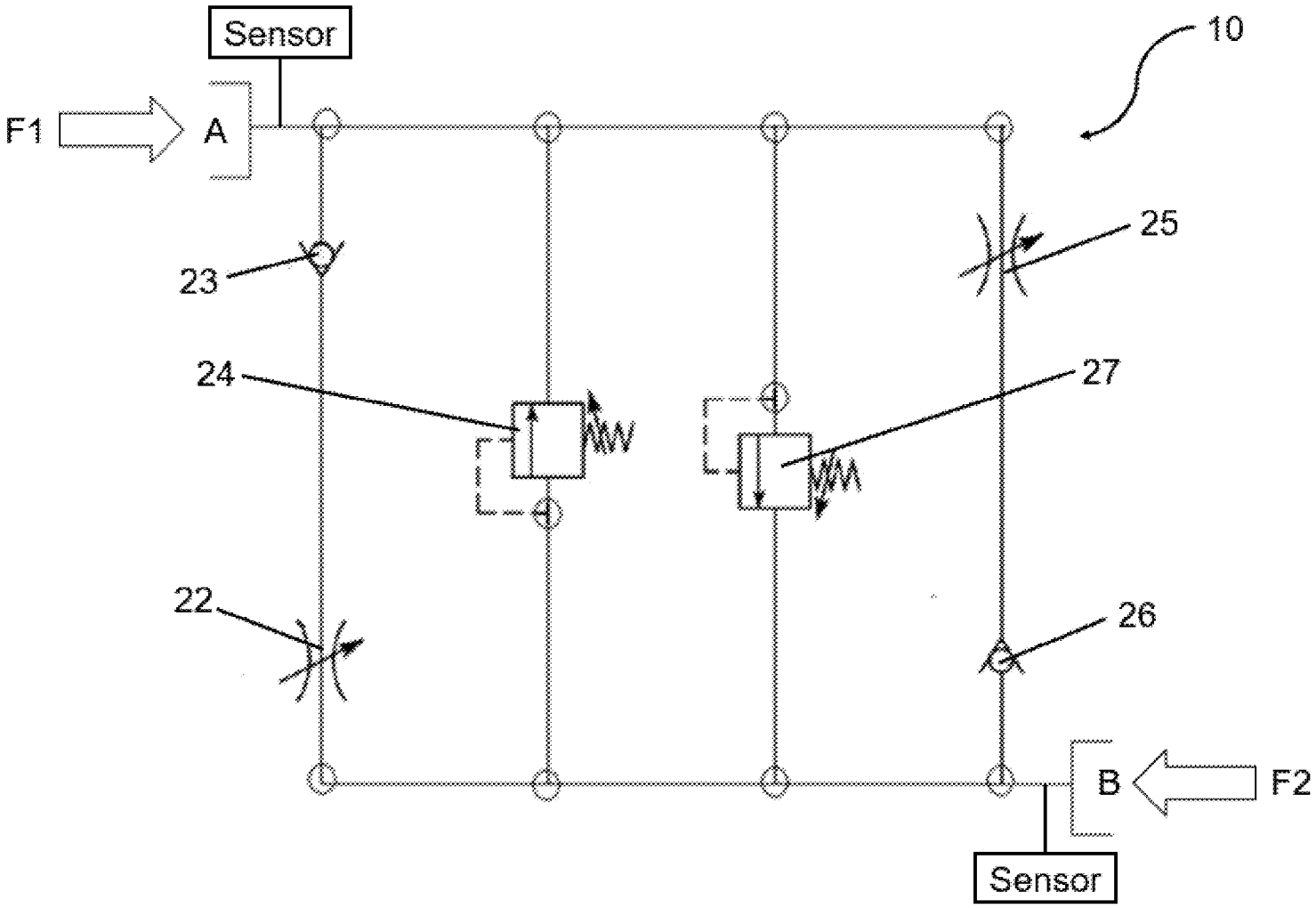
FIG. 9 shows the hydraulic circuit of the valve box in a preferred mode, with the sensors of the monitoring device.
Figure 10:
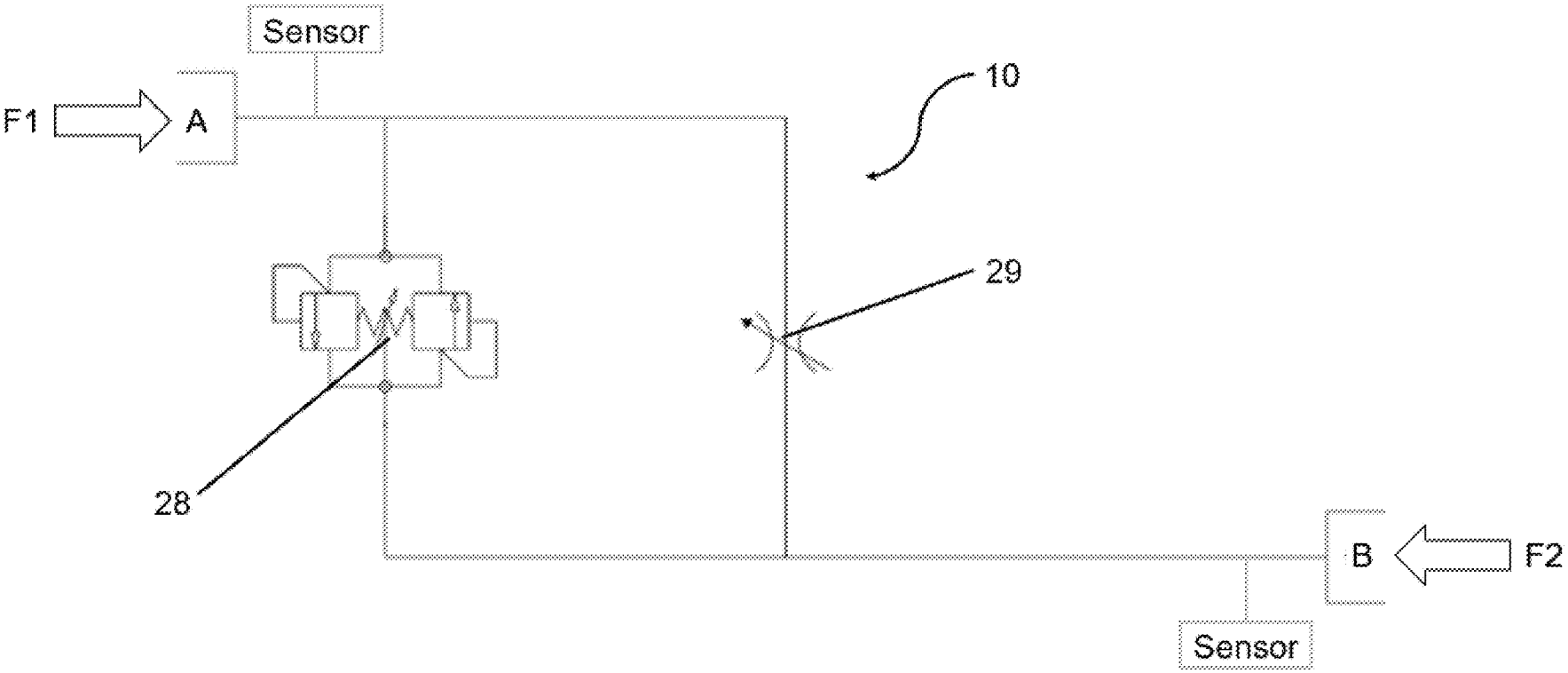
FIG. 10 shows the hydraulic circuit of the valve box in an alternative mode, with the sensors of the monitoring device.
Figure 11:
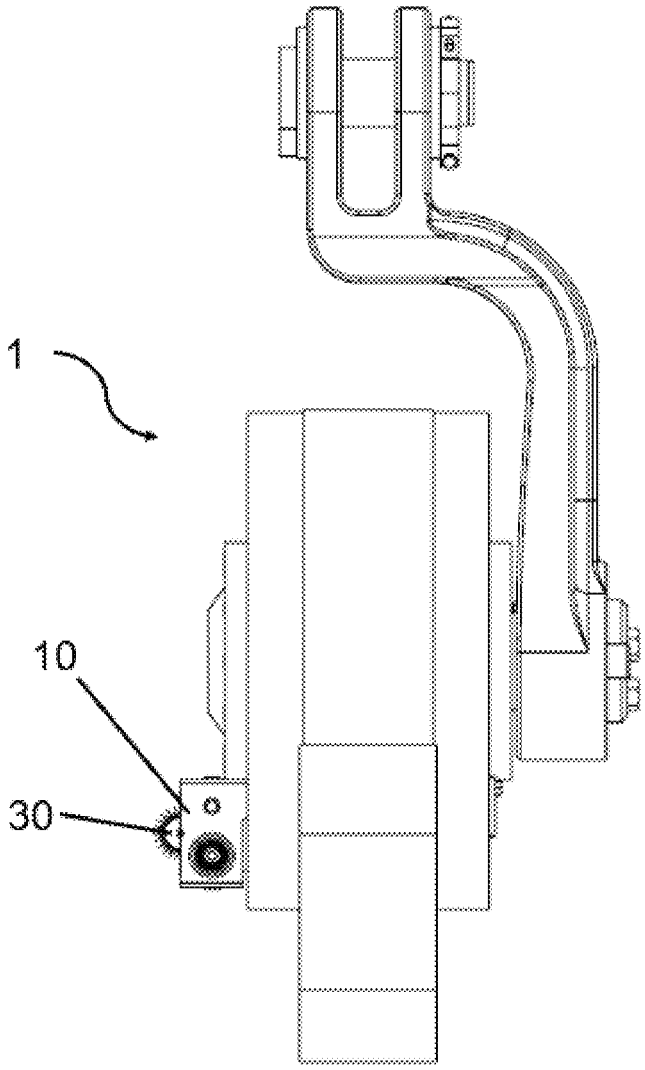
FIG. 11 shows an alternative mode of the snubber in which a monitoring device with a light signal is included to alert the state of the snubber.

In another preferred modality, to compensate for the deformations resulting from the high pressures that are generated inside the snubber (1), it comprises a monitoring device to monitor the status of the snubber (1). The monitoring device is installed in the lower part of the snubber (1), specifically, in the valve box (10) of the snubber (1). The monitoring device comprises at least one pressure sensor connected directly to each sub-chamber (A, B), from the valve box (10), to measure the pressure inside said sub-chambers (A, B), such as shown in FIGS. 9 and 10 for the two valve configuration modalities of the valve box (10). When the pressure inside any sub-chamber (A, B) is outside a pre-established operating range, it is an indicator that the snubber (1) is not working properly. The monitoring device includes processing means in which said sensors are connected, so that when the pressure sensors register a pressure outside the pre-established operating range for the sub-chambers (A, B), an alert is generated to warn component maintenance. The alert can be generated by means of a light signal (30) placed in the valve box, as shown schematically in FIG. 11, and connected to the processing means of the monitoring device. Alternatively, the monitoring device further comprises transmission means, connected to the processing means, which communicate with an external device to alert the status of the snubber (1). In particular, the transmission means communicates with the external device wirelessly.

Both the sealing means (17) on the vane (7) and the monitoring device can be used in a complementary way, that is, simultaneously in a snubber (1) or independently.

The invention claimed is:

1. A snubber (1) for an excavator bucket door that permanently controls the deformation due to the effect of working pressures during operation, improving braking performance, comprising:

a) a circular body (3) with a chamber (2), said chamber (2) having circular side plates (5);

b) a mounting foot (4) with perforations (21) for fixing to the excavator bucket;

c) a shaft (6) mounted on the circular side plates (5) by means of bearings (13) traversing said chamber (2), extending through the circular side plates (5), being connected to an arm (12) connected to the door from the excavator bucket by means of a connecting lug (20);

d) a vane (7) on said shaft (6) inside the chamber (2) that rotates in solidarity with it, where the vane (7) is in contact with the circular side plates (5) and the vane (7) having a seal (16) in its upper part commanded by springs (14);

e) a sealing surface (8) on the vane (7);

f) a vane blade (9), inside the chamber (2), which extends from the inner surface of the circular body (3) to the sealing surface (8) of the vane (7) between the circular side plates (5), where the vane blade (9) and the vane (7) divide the chamber (2) into a first sub chamber (A) and a second sub chamber (B) and the vane blade (9) having a seal (15) in its upper part commanded by springs (14);

g) a valve box (10) installed on the outside of the snubber (1) containing valves (22, 23, 24, 25, 26, 27) that allow double effect control over the opening and/or closing speed of excavator bucket door, wherein the vane (7) comprises sealing means (17) adjacent to each of the circular side plates (5) of the chamber (2), in which the sealing means (17) comprise sealing plates (19) commanded by springs (18) supported at one end to the sealing plates (19) and at the other end to a surface of a housing (11) of the vane (7), causing the sealing plates (19) to be pressed permanently against the circular side plates (5).

2. The snubber (1) for a door of an excavator bucket according to claim 1, wherein the number of springs (18) in each sealing plate (19) is between ten and fifteen.

3. The snubber (1) for an excavator bucket door according to claim 2, wherein the springs (18) are of the helical type.

4. The snubber (1) for a door of an excavator bucket according to claim 1, wherein the sealing plates (19) are metallic.

5. The snubber (1) for a door of an excavator bucket according to claim 1, wherein the sealing plates (19) are made of plastic.

6. The snubber (1) for a door of an excavator bucket according to claim 1, wherein the valve box (10) comprises a monitoring device, to monitor the status of the snubber (1), which comprises at least one pressure sensor directly connected to each sub-chamber (A, B), from the valve box (10), to measure the pressure inside it; processing means in which said at least two sensors are connected, so that when the pressure sensors register a pressure outside a pre-established operating range for each sub-chamber (A, B), an alert is generated.

7. The snubber (1) for an excavator bucket door according to claim 6, wherein the monitoring device comprises a light signal (30) placed in the valve box (10) and connected to the processing means for indicate alert.

8. The snubber (1) for an excavator bucket door according to claim 6, wherein the monitoring device comprises transmission means, connected to the processing means, to communicate with an external device to alert the status of the snubber (1).

9. The snubber (1) for an excavator bucket door according to claim 8, wherein the transmission means communicate wirelessly with the external device.

10. A snubber (1) for an excavator bucket door that permanently controls the deformation due to the effect of working pressures during operation, improving braking performance, comprising:

a) a circular body (3) with a chamber (2), said chamber (2) having circular side plates (5);

b) a mounting foot (4) with perforations (21) for fixing to the excavator bucket;

c) a shaft (6) mounted on the circular side plates (5) by means of bearings (13) traversing said chamber (2), extending through the circular side plates (5), being connected to an arm (12) connected to the door from the excavator bucket by means of a connecting lug (20);

d) a vane (7) on said shaft (6) inside the chamber (2) that rotates in solidarity with it, where the vane (7) is in contact with the circular side plates (5) and the vane (7) having a seal (16) in its upper part commanded by springs (14);

e) a sealing surface (8) on the vane (7);

f) a vane blade (9), inside the chamber (2), which extends from the inner surface of the circular body (3) to the sealing surface (8) of the vane (7) between the circular side plates (5), where the vane blade (9) and the vane (7) divide the chamber (2) into a first sub chamber (A) and a second sub chamber (B) and the vane blade (9) having a seal (15) in its upper part commanded by springs (14);

g) a valve box (10) installed on the outside of the snubber (1) containing valves (22, 23, 24, 25, 26, 27) that allow double effect control over the opening and/or closing speed of excavator bucket door, wherein the valve box (10) includes a monitoring device, to monitor the status of the snubber (1), which includes at least one pressure sensor connected directly to each sub-chamber (A, B), from the valve box (10), to measure the pressure inside; processing means in which said at least two sensors are connected, so that when the pressure sensors register a pressure outside a pre-established operating range for each sub-chamber (A, B), an alert is generated.

11. The snubber (1) for an excavator bucket door according to claim 10, wherein the monitoring device comprises a light signal (30) placed in the valve box (10) and connected to the processing means for indicate alert.

12. The snubber (1) for an excavator bucket door according to claim 10, wherein the monitoring device comprises transmission means, connected to the processing means, to communicate with an external device to alert the status of the snubber (1).

13. The snubber (1) for an excavator bucket door according to claim 12, wherein the transmission means communicate wirelessly with the external device.

* * * * *